United States Patent [19]

Her

[11] Patent Number: 4,823,971

[45] Date of Patent: Apr. 25, 1989

[54] HOUSING ASSEMBLY FOR A SMOKE EXHAUST ELECTRICAL FAN

[76] Inventor: Shiow-Ju Her, No. 23, Ya-Shiow Road, Ta-Ya Tsun, Ta-Ya Hsiang, Taichung Hsien, Taiwan

[21] Appl. No.: 24,248

[22] Filed: Mar. 10, 1987

[51] Int. Cl.[4] ..... B65D 6/00

[52] U.S. Cl. ..... 220/4 R; 98/115.1

[58] Field of Search ..... 220/4 R; 15/163; 110/208, 214, 162; 126/299 R, 110 R; 99/473; 98/115.1

[56] References Cited

U.S. PATENT DOCUMENTS

| | | | |
|---|---|---|---|
| 3,125,869 | 3/1964 | Winton | 98/115.1 |
| 4,211,154 | 7/1980 | Eakes | 98/115.1 |
| 4,334,260 | 6/1982 | Schmelter et al. | 220/4 R |

FOREIGN PATENT DOCUMENTS

| | | | |
|---|---|---|---|
| 2409288 | 9/1974 | Fed. Rep. of Germany | 98/115.1 |
| 1498549 | 10/1967 | France | 220/4 R |
| 9560 | of 1905 | United Kingdom | 220/4 R |

*Primary Examiner*—Willis Little

*Attorney, Agent, or Firm*—McGlew & Tuttle

[57] ABSTRACT

A housing assembly for a smoke exhaust electrical fan includes a front housing, a rear housing, a pair of opposed side housings, and an upper housing with an exhaust opening. The housings are assembled with each other by a transverse and/or longitudinal tongue and groove engagement so that each of the housings is detachable from the housing assembly. The housing assembly is used for receiving a motor and an electrical fan therein.

2 Claims, 5 Drawing Sheets

HOUSING ASSEMBLY FOR A SMOKE EXHAUST ELECTRICAL FAN

BACKGROUND OF THE INVENTION

The present invention relates to smoke exhaust electrical fans, and more particularly to a housing assembly thereof.

The several separate housings of a conventional smoke exhaust electrical fan are joined together by soldering connections or by rivets to leave a space therebetween so as to receive an electrical fan and a motor therein. When used for a long time, much oily dirt residue will accumulate on the housings. It is thus necessary that the housings be cleaned at regular intervals. However, it is difficult for the conventional housing assembly to be cleared of the oil dirt attached thereon, since the housing assembly is incapable of being completely disassembled. Additionally, the volume of the conventional housing assembly is relatively large. In transport and storage, it takes up a great deal of space. Furthermore, in transport, a package of a large size is necessary. These problems are undesirable from an economic standpoint.

SUMMARY OF THE INVENTION

It is therefore the main object of the present invention to provide a housing assembly for a smoke exhaust electrical fan, each housing of which assembly is detachable, so that not only is cleaning made easier, but also the space required to accommodate the unit for the purpose of transport and storage is sizably reduced due to the fact that the housing assembly can be disassembled.

It is therefore the main feature of the present invention to provide a housing assembly for a smoke exhaust electrical fan, all the housings of which assembly are joined detachably with each other by a transverse tongue and groove engagement and/or a longitudinal tongue and groove engagement.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
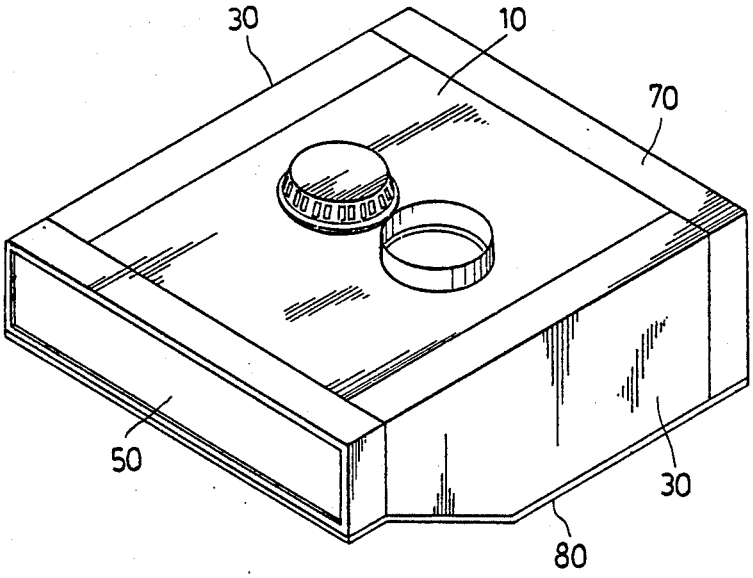
FIG. 1 is a perspective view showing an embodiment of a housing assembly for a smoke exhaust electrical fan according to the present invention.
Figure 2:
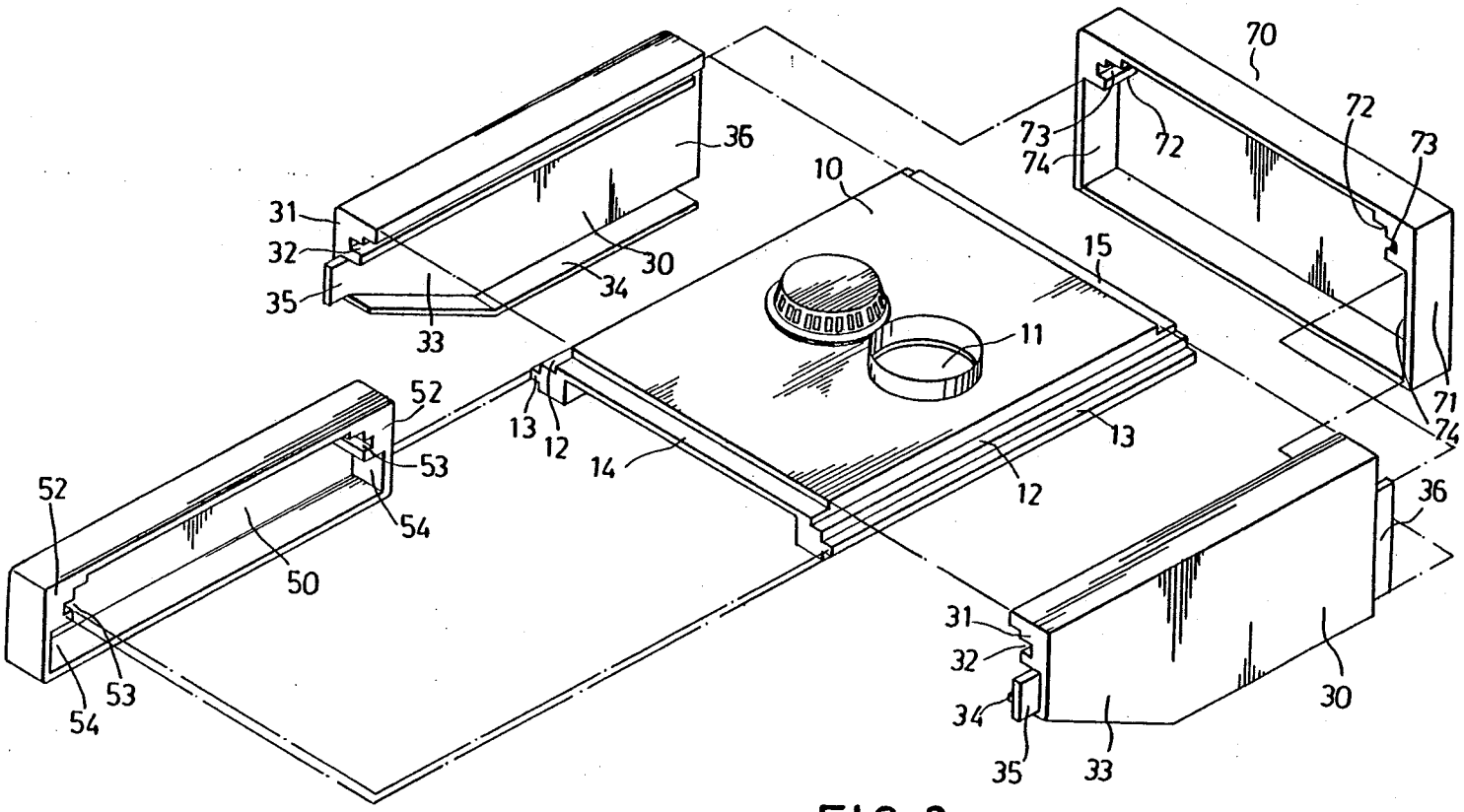
FIG. 2 is an exploded view showing the housing assembly of FIG. 1, which assembly is made of plastic material.
Figure 3:
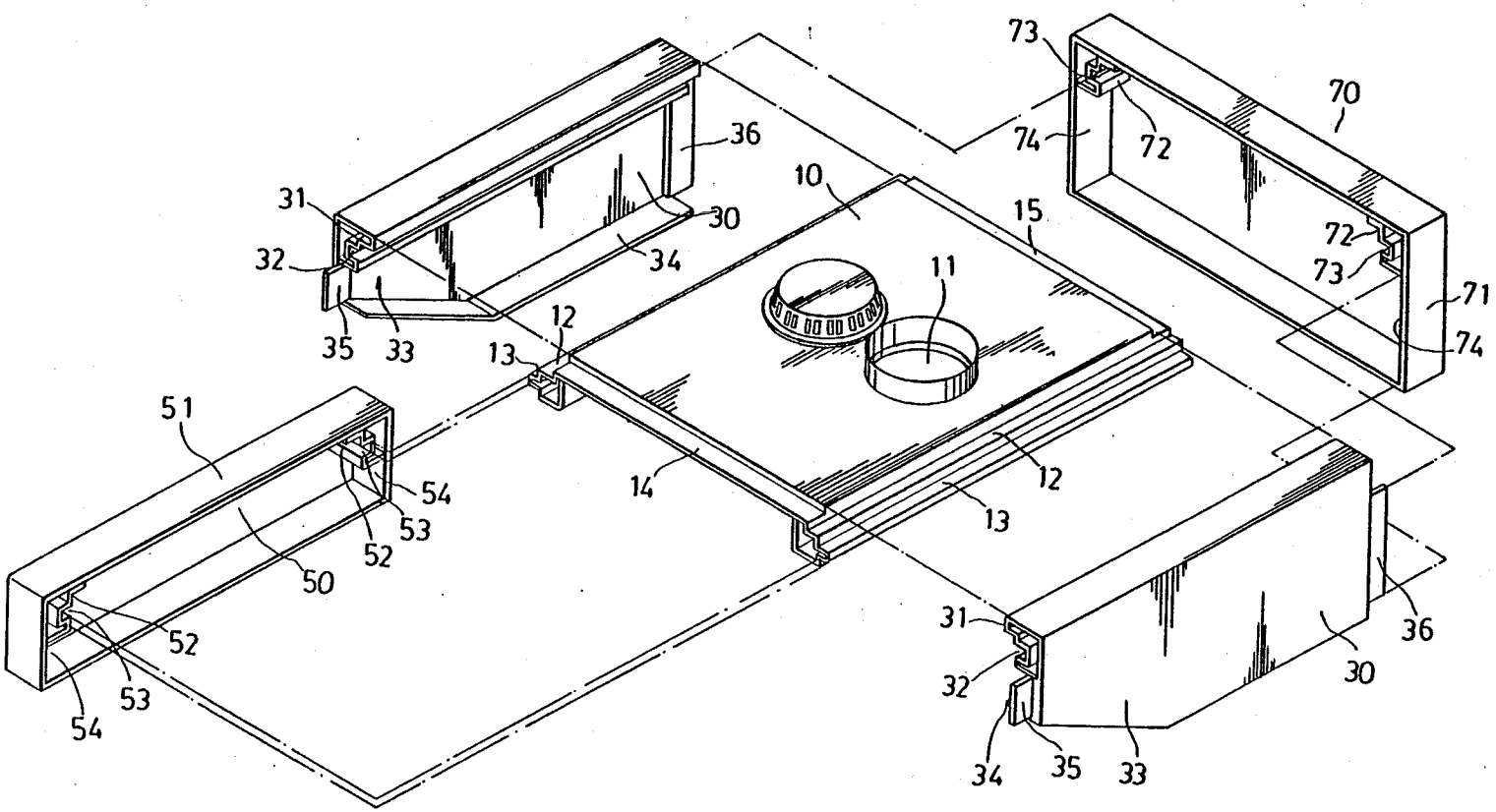
FIG. 3 is an exploded view showing the housing assembly of FIG. 1, which assembly is made of metal material.

Referring to FIG. 1 with reference to FIGS. 2 and 3, according to an embodiment of the present invention, a housing assembly for a smoke exhaust electrical fan includes an upper housing 10, two side housing 30, a front housing 50, and a rear housing 70. The structure of the housing assembly shown in FIG. 2 is the same as one shown in FIG. 3 except that the former is made of plastic material, but the latter is made of extruded metal material.

The upper housing 10 is generally rectangular. It includes a circular opening 11 adapted to be in communication with an exhaust tube (not shown), a pair of stepped side rims 12 with transverse tongues 13, a front rim 14, and a rear rim 15. The rims 12, 14, and 15 are projecting transversely from the body of the upper housing 10 at a level slightly lower than that of the upper surface of the body of the upper housing 10.

Each of the side housings 30 includes a stepped upper end portion 31 with a first transverse groove 32 opposing the transverse tongue 13 of the upper housing 10, a tapered front portion 33, a lower flange 34 projecting along the lower side of the upper housing 30, a front longitudinal tongue 35, and a rear longitudinal tongue 36. The size of the rear longitudinal tongue 36 is larger than that of the front longitudinal tongue 35. The stepped upper end portion 31 is of a step-shape conforming to the stepped side rims 12 of the upper housing 10.

The front housing 50 has a rearwardly projecting flange 51 at the outer periphery thereof so that it may open rearwardly. On the inner wall of the rearwardly projecting flange 51, there are two stepped portions 52 opposing the stepped side rims 12 of the upper housing 10. Each of the stepped portions 52 is also of a step-shape conforming to the stepped side rims 12 of the upper housing 10 so as to also have a second transverse groove 53. On the inner wall of the rearwardly projecting flange 51 below each of the stepped portions 52, there is a first recess 54 which is well matched with the front longitudinal tongue 35 of the corresponding side housing 30.

The rear housing 70 is the same as the front housing 50 in construction. That is to say, it includes a forwardly projecting flange 71, two stepped portions 72, two third transverse grooves 73, and two second recesses 74. Whereas the size of the second recesses 74 is larger than that of the first recesses 54 so as to be matched closely with the rear longitudinal tongues 36 of the side housings 30.

In assembly, the upper housing 10 is first engaged with the side housings 30 by means of the transverse tongues 13 and the first grooves 32. Then, the front housing 50 and the rear housing 70 are engaged with the upper housing 10 by means of the transverse tongues 13 and the second grooves 53, 73, and with the side housings 30 by means of the longitudinal tongues 35, 36 and the recesses 54, 74. Preferably, the tongues 13, 35, 36, the first grooves 32, the second grooves 53, 73, and the recesses 54, 74 are sized so that the tranverse and longitudinal engagements are tight and firm.

After a motor and an electrical fan are positioned in the housing assembly, a base plate 80 (see FIG. 1) is secured onto the flanges 34, 51, 71 of the housings 30, 50, 70. For securement of the base plate 80, the flanges 34, 51, 71 may be provided with fastener holes (not shown) so that they can be joined together by screws. Certainly, an inlet (not shown) is necessary to be provided in the base plate 80 for the purpose of drawing oil gas therein.

Figure 4:
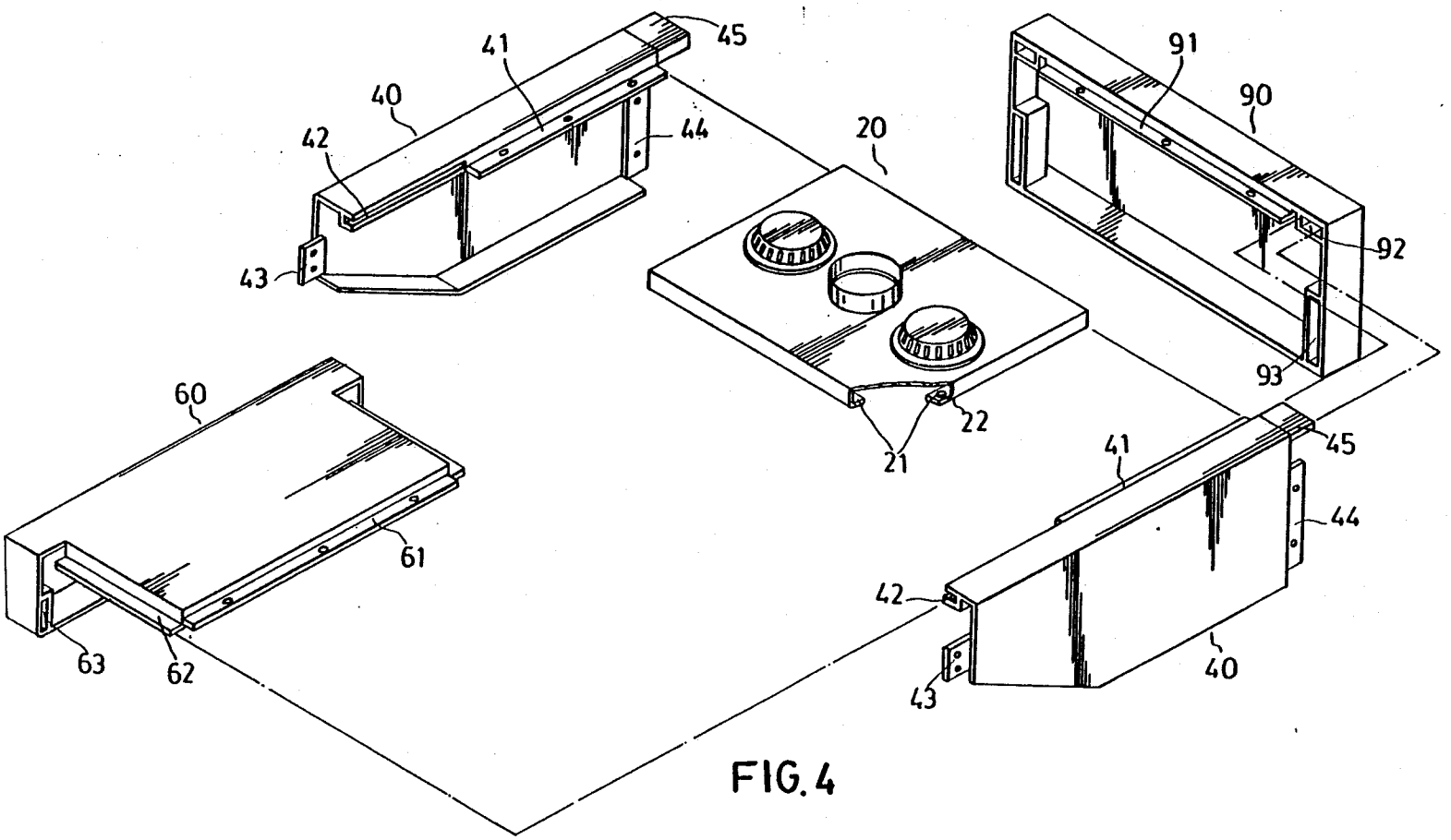
FIG. 4 is an exploded view showing another embodiment of a housing assembly for a smoke exhaust electrical fan according to the present invention.
Figure 5:
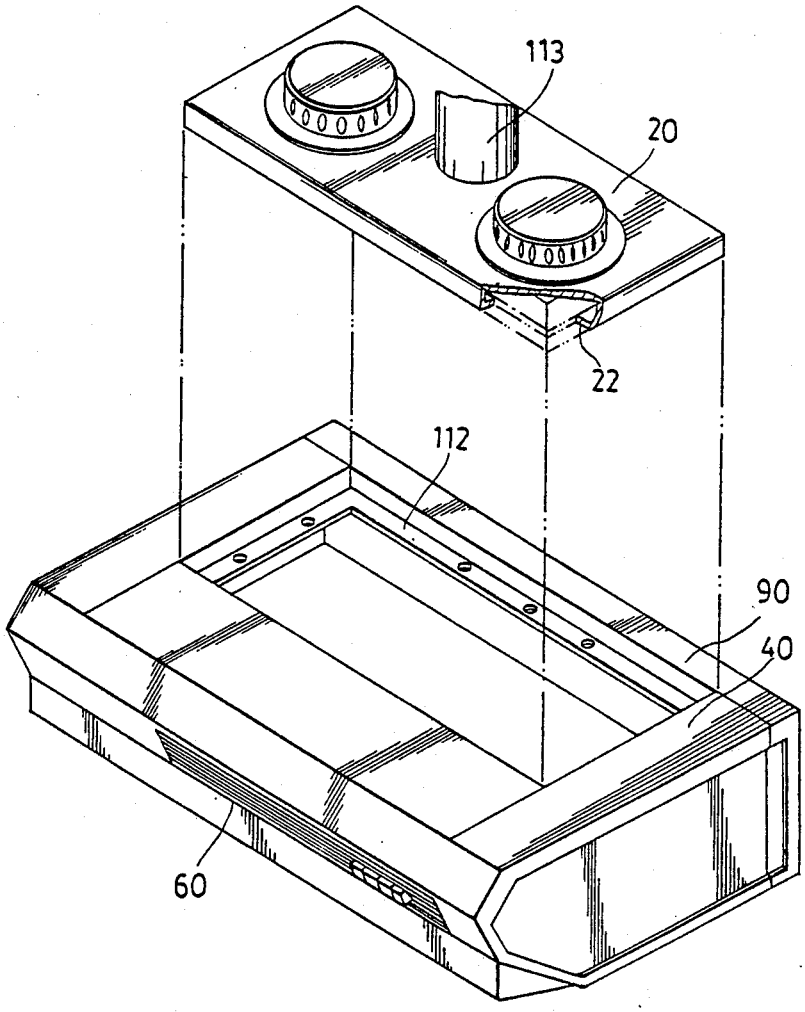
FIG. 5 is a partially exploded view showing the housing assembly of FIG. 4.

Referring to FIGS. 4 and 5, there is shown another embodiment of the present invention. Each of front housing 60, side housings 40, and rear housing 90 is formed with a transverse rib 61, 41, 41, 91 which projects inwardly from the inward surface thereof and which is provided with three fastener holes. Projecting from the lower end of an upper housing 20 is a first inward flange 21 with twelve fastener holes opposing the fastener holes of the front, side, and rear housings 60, 40, 90. When the front, side, and rear housings 60, 40, 90 are assembled together, the transverse ribs 61, 41, 41, 91 are engaged to form a second inward flange 112 (see FIG. 4) so that the upper housing 20 can be screwed onto the second inward flange 112. It is understood that the upper housing 20 is formed with an opening which is in communication with an exhaust tube 113.

In order for a tongue and groove engagement, the front housing 60 is formed generally in a T-shape and includes a pair of laterally projecting transverse tongues 62 and a pair of forwardly indented longitudinal slots 63. The rear housing 90 includes a pair of rearwardly indented transverse slots 92 and a pair of rearwardly indented longitudinal slots 93. Each of the side housings 40 includes a laterally indented transverse groove 42 receiving the corresponding transverse tongue 62 of the front housing 60 therein, a forwardly projecting longitudinal tongue 43 inserted in the corresponding longitudinal slot 63 of the front housing 60, a rearwardly projecting longitudinal tongue 44 inserted in the corresponding longitudinal slot 93 of the rear housing 90, and a rearwardly projecting transverse tongue 45 inserted in the corresponding transverse slot 92 of the rear housing 90.

Since each housing is detachable from the housing assembly, in transport and storage, the space required to accommodate the detachable housings can be reduced 30–50 percent in comparison to conventional housing assemblies. In addition, it is understood that the detachable housings is easily cleaned.

With the present invention thus explained, it is apparent that various modifications and variations can be made without departing from the scope and spirit of the present invention. It is therefore intended that the present invention be limited as indicated in the appended claims.

What is claimed is:

1. A housing assembly for a smoke exhaust electrical fan, comprising: a front housing; a rear housing; a pair of opposed side housings; and an upper housing with an exhaust opening, said exhaust opening opening downwardly thereby drawing smoke downwardly, each of said front, rear, side and upper housings being detachable from the housing assembly, each of said side, front and rear housings being connected to said upper housing by a transverse tongue and groove engagement, and each of said side housings being connected to each of said front and rear housings by a longitudinal tongue and groove engagement.

2. A housing assembly for a smoke exhaust electrical fan, comprising: a front housing; a rear housing; a pair of opposed side housings; and an upper housing with an exhaust opening, said exhaust opening opening downwardly for drawing smoke downwardly, each of said front, rear, side and upper housings being detachable from the housing assembly, any adjacent two of said front, rear, and side housings being connected together by both transverse and longitudinal tongue and groove engagements to form a central opening between said front, rear and side housings, each of said front, rear and side housings being formed with a transverse rib projecting inwardly from the inward surface thereof so that after they are connected together, a sequential inward flange is formed between said front, rear and side housings; and, an upper housing affixed to said inward flange by screws so as to seal said central opening.

* * * * *